US005162099A

United States Patent [19]

Meyer et al.

[11] Patent Number: 5,162,099

[45] Date of Patent: Nov. 10, 1992

[54] PROCESS FOR PRODUCING A SINTERED COMPACT FROM STEEL POWDER

[75] Inventors: Gundolf Meyer, Birmenstorf; Christoph Tönnes, Wettingen, both of Switzerland

[73] Assignee: Asea Brown Boveri Ltd., Baden, Switzerland

[21] Appl. No.: 845,033

[22] Filed: Mar. 3, 1992

[30] Foreign Application Priority Data

Mar. 13, 1991 [CH] Switzerland ..... 762/91

[51] Int. Cl.[5] ..... B22E 1/00

[52] U.S. Cl. ..... 419/25; 419/31; 419/45; 419/54; 419/57; 419/58

[58] Field of Search ..... 419/54, 57, 58, 25, 419/31, 45

[56] References Cited

U.S. PATENT DOCUMENTS 4,436,696 3/1984 Buck et al. ..... 419/57
4,614,638 9/1986 Kuroishi et al. ..... 419/39

OTHER PUBLICATIONS

Metals Handbook, Ninth Edition, vol. 7, "Powder Metallurgy", American Society for Metals, 1984, pp. 360–361.

"Sintereisen und Sinterstahl", Kieffer, et al., Wien, Springer-Verlag 1948, pp. 390–395.

"Fortschritte der Pulvermetallurgie", Band II, Technologische Einrichtungen und Pulvermetall. Werkstoffe, Eisenkolb, et al., Berlin, 1963, pp. 166–171.

*Primary Examiner*—Stephen J. Lechert, Jr.
*Attorney, Agent, or Firm*—Burns, Doane, Swecker & Mathis

[57] ABSTRACT

The process serves for producing a carbon-containing sintered compact from steel powder. In this process, the steel powder is heated to sintering temperature in an atmosphere containing, at least for a time, carbon monoxide, is kept at sintering temperature over a predetermined period of time and the sintered compact formed thereby is subsequently cooled.

In this process, the carbon content of the sintered compact to be produced is to be set to a predetermined value in a way which is simple and suitable for mass production.

This is achieved by the partial pressure of the carbon monoxide in the atmosphere being changed selectively during the execution of the production process, and by this change being controlled in such a way that the carbon content of the sintered compact is set to the predetermined value after execution of the production process.

13 Claims, No Drawings

PROCESS FOR PRODUCING A SINTERED COMPACT FROM STEEL POWDER

BACKGROUND OF THE INVENTION

1. Field of the Invention

The invention is based on a process for producing a carbon-containing sintered compact from steel powder, in which the steel powder is heated to sintering temperature in an atmosphere containing, at least for a time, carbon monoxide, is kept at sintering temperature over a predetermined period of time, and the sintered compact formed thereby is subsequently cooled.

2. Discussion of Background

The invention relates in this respect to a prior art such as that specified, for example, in Metals Handbook Ninth Edition Vol 7 Powder Metallurgy, pages 360 and 361. In this prior art, a process for producing a sintered compact, in which steel powder is mixed with graphite powder and the resulting powder mixture is subsequently sintered, is described. The graphite is intended to have two effects here: firstly it is intended to reduce metal oxides in the steel powder, secondly it is intended to diffuse into the steel powder, in order thus to bring the carbon content of the sintered compact to a predetermined value. This is necessary since otherwise a considerable decarburization of the steel powder takes place in the atmosphere acting during sintering, which is frequently a vacuum or contains an inert gas. During this decarburization, the carbon in the steel powder escapes by reacting with oxygen, for instance from or on the grains of steel powder or from the atmosphere, to form carbon monoxide, which is generally flushed away or pumped away with the atmosphere. In order to avoid such decarburization, an extremely homogeneous and finely distributed mixture of steel and graphite powder is necessary. This requires complex technology and, in a production process set up for mass production, can scarcely be tested for the degree of distribution for the purposes of quality control.

SUMMARY OF THE INVENTION

Accordingly, one object of this invention, as it is defined in patent claim 1, is to provide a novel process of the type mentioned at the beginning with which the carbon content of the sintered compacts produced by it can be set in a way which is simple and suitable for mass production.

The process according to the invention is distinguished by the fact that sintered compacts can be produced on the basis of a steel powder with a carbon content—for instance corresponding to the starting steel powder—by technological measures which are comparatively simple to perform. The process according to the invention ensures a largely consistently good quality of the sintered compacts produced by it and can be used in particular to particular advantage in the case of the manufacture of mass products on account of the resulting cost advantages combined at the same time with high reliability.

DESCRIPTION OF THE PREFERRED EMBODIMENTS

Preferred illustrative embodiments of the invention are described below. In these illustrative embodiments, a X20CrMoV121 steel powder is used as starting material for the production of sintered compacts. The chemical composition of this steel powder is:

| Fraction in percent by weight | Component |
|---|---|
| 0.21 | C |
| 11.6 | Cr |
| 1.08 | Mo |
| 0.30 | V |
| 0.58 | Mn |
| 0.38 | Ni |
| 0.36 | Si |
| Remainder | Fe |

The structure of this starting material is predominantly martensitic, with relatively small fractions of δ-ferrite and austenite. The particle size of the powder grains, determined by screening, is less than 50 μm. The oxygen content inside the powder is 55 ppm and exhibits both dissolved oxygen and oxides. In addition there are oxides and adsorbed oxygen on the surface of the powder of 100–1000 ppm.

Instead of such a steel powder, other steel powders can also be used in the production of sintered compacts by the process according to the invention.

Right-parallelepipedal molds with dimensions of about 100 mm×15 mm×10mm are in each case filled with 50 g of powder. The filled molds are introduced into a sintering furnace provided with an aluminum oxide tube of about 50 mm in diameter. The furnace is fed a sintering gas under atmospheric pressure at an inflow rate of about 0.5 l/min.

The furnace charged with the filled molds is heated up at a rate of about 10° C./min to a sintering temperature of about 1330° C., left at sintering temperature for about one hour and then cooled at a rate of about 10° C./min to room temperature.

During heating-up, the furnace is initially fed an inert gas, such as in particular argon, as sintering gas.

Above a temperature of preferably 1000° C., a gas change takes place. The sintering gas fed in from then on additionally exhibits apart from the inert gas at least carbon monoxide as well. As a result, below a temperature of about 1200° C. the steel powder carburizes. Above a temperature of about 1200° C., a decarburization takes place.

After sintering, during cooling of the sintered compacts formed, a renewed change of the sintering gas is performed at a temperature of about 1200° C. Below this temperature, again from then on inert gas, such as for instance argon, is fed in. As a result, a carburization of the sintered compacts following the previously performed decarburization is avoided. By suitable choice of the temperatures at which the two gas changes are performed, it is thus possible to bring into equilibrium the carburization and decarburization of the steel powder, and of the sintered compacts formed therefrom, in the temperature interval determined by these temperatures.

Retaining the process parameters determined in particular by the duration of sintering as well as the heating and cooling rates, the carbon content of the sintered compacts can be set to a predetermined value deviating from the carbon content of the steel powder by shifting one or both temperatures.

What is important in particular is that the partial pressure of the atmosphere surrounding the sintered compact during the execution of the production process is changed selectively, and that this change is controlled in such a way that the carbon content of the sintered compact is set to the predetermined value.

If the sintering gas is used as the atmosphere, the composition of the sintering gas can be changed during the execution of the production process not only —as described before—in stages, but also continuously for setting the carbon content to the predetermined value. In this case, the carbon content of the sintered compact to be produced can be fixed particularly accurately, since then the equilibrium crucial for maintaining the predetermined carbon content and defined by the ratio of the partial pressures of carbon monoxide and carbon dioxide can be maintained by continuous changing of the partial pressure of the carbon monoxide during the overall production process.

If the carbon monoxide content is changed in stages—as described above—it is recommendable to switch over from the inert gas to a sintering gas containing carbon monoxide during heating-up at a temperature between 900 and 1200° C. With the parameters specified above such as the powder composition, the size of the sintered compacts to be produced, the heating and cooling rates as well as the duration of sintering, a switching-over temperature of about 1000° C. during heating-up and a switching-over temperature of about 1200° C. during cooling have been found to be particularly favorable.

During heating-up, when the switching-over temperature is reached up to 10% by volume of carbon monoxide are fed to the sintering gas. It is recommendable additionally to feed the sintering gas a reducing gas, such as preferably hydrogen, when the switching-over temperature is reached. As a result, this additionally achieves avoidance to a great extent of oxidation of the sintered compact during the carburization of the same, effected by the carbon monoxide. This is of particular advantage in the case of producing sintered compacts which are comparatively porous and/or provided with a powder filling. The sintering gas can be fed up to 20% by volume of hydrogen. It has proved very successful to feed in a sintering gas having about 5% by volume of carbon monoxide and about 10% by volume of hydrogen when the switching-over temperature is reached during heating-up.

It is possible to execute the production process in a closed vessel. In this case, the timing of the sintering operation is controlled in such a way that carbon oxides formed in the steel powder at high temperatures are decomposed upon cooling and resulting carbon is reincorporated into the sintered compact.

Furthermore, the production process can also be executed in a vessel in which the steel powder, and consequently also the sintered compact to be produced, is surrounded by elementary carbon, such as preferably graphite. In this case, it is necessary for the graphite to be in relatively close contact with the steel powder or the sintered compact. The residual oxygen of the sintering gas then obtains the carbon required for building up an atmosphere containing carbon monoxide, localized around the sintered compact, from the graphite surround and from then on influences the carbon content of the steel powder or the sintered compact insignificantly.

It is highly recommendable to perform a heat treatment on the steel powder in a reducing atmosphere before the sintering process. If such a heat treatment is carried out at temperatures of up to 1400° C., the oxygen in the scarcely avoidable metal oxides of the steel powder or oxidizing on the powder particles is removed to a great extent by reaction with the reducing component of the atmosphere. In the subsequent sintering process, this oxygen can then no longer contribute to a decarburization of the steel powder with the formation of carbon monoxide. A steel powder preliminarily annealed in this way can be set much more easily to a predetermined carbon content in the subsequent sintering process than a steel powder which has not been heat-treated, since one of the factors influencing the carbon content of the sintered compact is eliminated by the preliminary annealing.

If the steel powder is annealed in a hydrogen atmosphere, the components of readily reducible oxides, such as for example FeO and/or $Cr_2O_3$, are considerably reduced already at temperatures above 800 to 1000° C. On the other hand, difficultly reducible oxides, such as for example MnO, are reduced to a minimum, for example by combining with sulfur.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A process for producing a carbon-containing sintered compact from steel powder, in which the steel powder is heated to sintering temperature in an atmosphere containing, at least for a time, carbon monoxide, is kept at sintering temperature over a predetermined period of time, and the sintered compact formed thereby is subsequently cooled, wherein the partial pressure of the carbon monoxide in the atmosphere is changed selectively during the execution of the production process, and wherein this change is controlled in such a way that the carbon content of the sintered compact is set to a predetermined value after execution of the production process.

2. The process as claimed in claim 1, wherein the composition of a sintering gas used as atmosphere is changed continuously during the execution of the production process.

3. The process as claimed in claim 1, wherein the composition of a sintering gas used as the atmosphere is changed in stages during the execution of the production process.

4. The process as claimed in claim 3, wherein inert gas is predominantly used as the sintering gas during heating below a first temperature, wherein at least carbon monoxide is added to the inert gas above the first temperature, and wherein again inert gas is used predominantly as the sintering gas during cooling below a second temperature.

5. The process as claimed in claim 4, wherein the sintering gas used between the first temperature and the second temperature additionally contains hydrogen.

6. The process as claimed in claim 4, wherein the first temperature and the second temperature are chosen in such a way that the carburization and decarburization of the steel powder and of the sintered compact formed from it are brought into equilibrium in the temperature interval determined by these temperatures.

7. The process as claimed in claim 4, wherein the first temperature is fixed between 900 and 1200° C.

8. The process as claimed in claim 7, wherein the first temperature is fixed at about 1000° C. and the second temperature is fixed at about 1200° C.

9. The process as claimed in claim 8, wherein the sintering gas fed in between the first temperature and the second temperature contains up to 10% by volume of carbon monoxide and up to 20% by volume of hydrogen.

10. The process as claimed in claim 1, wherein the production process is executed in a closed vessel, and wherein the timing of the sintering operation is controlled in such a way that carbon oxides formed from the steel powder at high temperatures are decomposed upon cooling and resulting carbon is incorporated into the sintered compact.

11. The process as claimed in claim 1, wherein the sintered compact is surrounded by elementary carbon.

12. The process as claimed in claim 1, wherein the steel powder is heat-treated in a reducing atmosphere before sintering.

13. The process as claimed in claim 12, wherein the steel powder is annealed in a hydrogen atmosphere.

* * * * *